US006881385B2

(12) United States Patent
Fersing et al.

(10) Patent No.: US 6,881,385 B2
(45) Date of Patent: Apr. 19, 2005

(54) DEVICE FOR THE ISOMERIZATION OF GASOLINE WITH A HIGH BENZENE CONTENT

(75) Inventors: Marc Fersing, Bergues (FR); Pedro Nascimento, Le Havre (FR)

(73) Assignee: Total Raffinage Distribution S.A., Puteaux (FR)

( * ) Notice: Subject to any disclaimer, the term of this patent is extended or adjusted under 35 U.S.C. 154(b) by 538 days.

(21) Appl. No.: 10/107,477

(22) Filed: Mar. 28, 2002

(65) Prior Publication Data

US 2002/0139712 A1 Oct. 3, 2002

Related U.S. Application Data

(62) Division of application No. 09/282,442, filed on Mar. 31, 1999, now Pat. No. 6,416,657.

(30) Foreign Application Priority Data

Mar. 31, 1998 (FR) ..... 9803958

(51) Int. Cl.[7] ..... B01J 8/02

(52) U.S. Cl. ..... 422/179; 422/190; 422/198; 422/216

(58) Field of Search ..... 422/179, 190, 422/198, 216

(56) References Cited

U.S. PATENT DOCUMENTS

| | | | | |
|---|---|---|---|---|
| 2,393,041 A | * | 1/1946 | Greensfelder | 585/734 |
| 2,920,033 A | | 1/1960 | Beavon | |
| 3,359,198 A | | 12/1967 | Lengemann | |
| 3,674,681 A | | 7/1972 | Lyon | |
| 3,755,144 A | | 8/1973 | Asselin | |
| 3,864,240 A | * | 2/1975 | Stone | 208/64 |
| 4,129,496 A | | 12/1978 | Loboda | |
| 4,333,818 A | | 6/1982 | Coste | |
| 4,432,862 A | | 2/1984 | Swart et al. | |
| 4,747,933 A | * | 5/1988 | Hibbs | 208/79 |
| 5,003,118 A | | 3/1991 | Low et al. | |
| 5,073,667 A | | 12/1991 | Tonks et al. | |
| 5,091,074 A | | 2/1992 | Maxwell et al. | |
| 5,146,037 A | | 9/1992 | Zarchy et al. | |
| 5,227,554 A | * | 7/1993 | Chou | 585/303 |
| 5,245,102 A | | 9/1993 | Zarchy et al. | |
| 5,360,534 A | * | 11/1994 | Rice et al. | 208/139 |
| 5,516,964 A | | 5/1996 | Unmansky et al. | |
| 5,648,590 A | | 7/1997 | Hsu et al. | |
| 5,763,732 A | * | 6/1998 | Mariette et al. | 585/748 |
| 5,830,345 A | | 11/1998 | Lee et al. | |

FOREIGN PATENT DOCUMENTS

| | | |
|---|---|---|
| EP | 552 070 | 7/1993 |
| EP | 661 370 | 7/1995 |
| FR | 2 623 203 | 5/1989 |

OTHER PUBLICATIONS

John McMurry "Organic Chemistry" Copyright 1984 by Wadsworth, Inc., p. 74.

* cited by examiner

*Primary Examiner*—N. Bhat
(74) *Attorney, Agent, or Firm*—Sughrue Mion, PLLC

(57) ABSTRACT

A method for the isomerization of a hydrocarbonic charge containing a substantial quantity of paraffin base hydrocarbons with 5 or 6 carbon atoms and a benzene content that is greater than or equal to 2% by weight, in which the charge to be treated passes, in the presence of hydrogen, at a total pressure greater than or equal to $10.10^5$ Pa (10 bars) and at an average temperature ranging between 100 and 200° C., through at least one reactor (5) containing a catalyst. An adjunctive fluid is introduced in the upstream section of the reaction zone; a fluid that at 40° C. and under atmospheric pressure ($1.0134.10^5$ Pa), is in a gaseous phase and has a density that is less than or equal to that of the normal-pentane taken into account under the same conditions.

8 Claims, 3 Drawing Sheets

DEVICE FOR THE ISOMERIZATION OF GASOLINE WITH A HIGH BENZENE CONTENT

This is a divisional of application Ser. No. 09/282,442 filed Mar. 31, 1999; now U.S. Pat. No. 6,416,657 which is incorporated herein by reference.

BACKGROUND OF THE INVENTION

This invention relates to an enhanced method and device for the isomerization of gasoline with a high benzene content.

It is known that the oil industry resorts to methods that are aimed at increasing the octane number of these gasolines by transforming the straight paraffins they contain into branched paraffins (or isoparaffins). In general, the charge to be treated is composed mostly of saturated hydrocarbons with five or six carbon atoms, as well as lower percentages of hydrocarbons with four or seven carbon atoms, and of benzene that, as we all know, is relatively difficult to separate from the other hydrocarbons with six carbon atoms.

In order to carry out the isomerization reaction, the charge to be treated is most often mixed with hydrogen and a possible recycle, it is then directed toward at least one reactor containing an appropriate fixed-bed catalyst. The temperature in this reactor usually ranges between 120 and 190° C. When exiting the isomerization reactor (or reactors), the effluents are carried toward one or several separation columns. Often times, the isoparaffins are then separated from the non isomerized paraffins: in principle, the first are sent to the gasoline pool, whereas the second are possibly recycled in the reactor, in order to be transformed therein. We also know that, under isomerization reaction conditions, the benzene that is present in the charge is hydrogenated, due to the presence of the hydrogen and the hydrogenating transition metals that enter into the composition of the isomerization catalysts. This results in a significant heat release in the upstream part of the isomerization reactor due to the exothermicity of this reaction, which is detrimental to the efficiency of the isomerization reaction.

This is why we generally use two isomerization reactors: the first reactor, in which, in addition to the isomerization of paraffins, the hydrogenation of traces of benzene present in the charge occurs, operates at a temperature slightly higher that the second, where the actual isomerization reaction is finished. Indeed, from a kinetic point of view, the isomerization reaction of paraffins is slower than the hydrogenation reaction of the benzene. Furthermore, the lower temperature in the second reactor is thermodynamically favorable to the creation of the desired branched products.

However, the benzene content of the isomerization charges remains relatively limited. Indeed, a rule commonly accepted suggests that a 1% increase of the benzene content in the charge to be treated produces an increase in temperature of 10° C. inside the first isomerization reactor. Knowing that the reactions other than the hydrogenation of benzene already produce an increase in temperature in the range of 15° C. on their own, the benzene content of the charge entering this reactor must then be limited to 4%. Beyond this content, the temperature inside the reactor is too high, which, in the end, not only harms the catalyst but also the unit, built to operate at a limited temperature. Furthermore, when the temperature is high, undesirable secondary reactions occur, such as for example, hydrocracking reactions of the charge.

However, it seems desirable to be able, in the isomerization unit, to treat charges with a benzene content that is much higher than the 4% generally accepted.

Indeed, considering the carcinogenic character of benzene, the current standards have a tendency to impose tougher and tougher limitations on the content of this composition in fuels.

An ingenious solution then consists in allowing, in the isomerization unit, in addition to the traditional charges, gasoline cuts that are rich in benzene, such as certain gasoline cuts resulting from catalytic reforming or cracking units: the benzene that is present in these cuts is thus hydrogenated in the isomerization unit, and this operation allows in fine to clearly reduce the benzene content of said cuts before carrying them to the "gasoline pool", term by which we designate the overall bases used in manufacturing oil products.

However, this need to treat more benzene during isomerization comes up against the limitation tied to the temperature in the first reactor. Indeed it is still essential that this temperature be maintained at an average value in the range of 180° C., above which the hydrocracking reactions, which are very exothermic, begin.

In order to rid oneself of this limitation, U.S. Pat. No. 5,003,118 proposes to introduce, upstream from the actual isomerization reactor (or reactors), a charge pretreatment reactor, specifically intended to execute the hydrogenation of the benzene present in this charge. In this way, the unit can treat charges with a higher benzene content. However, this solution has the disadvantage of being costly and requires building additional equipment. Furthermore, it is not absolutely flexible to the extent that the hydrogenation reactor is of no use in the case of a charge with a low benzene content.

SUMMARY OF THE INVENTION

Therefore, the intent of this invention is to propose a method for the isomerization of gasolines with a high benzene content which will make it possible to remedy the problems encountered in the prior art in an easy and inexpensive way.

This invention also intends to propose a particularly flexible isomerization method that will allow it to adapt quickly to the different charges brought to it.

With this in mind, the object of this invention is a method for the isomerization of a hydrocarbonic charge that contains a substantial quantity of paraffin base hydrocarbons with 5 or 6 carbon atoms and has a benzene content that is greater than or equal to 2% by weight, in which the charge to be treated passes, in the presence of hydrogen, at a total pressure that is greater than or equal to $10–10^5$ Pa (10 bars) and at an average temperature ranging between 100 and 200° C., through at least one reactor containing a paraffin base hydrocarbon isomerization catalyst, this method being characterized by the fact that, in the upstream part of the reaction zone, we introduce an adjunctive fluid that, at 40° C. and under atmospheric pressure ($1.0134.10^5$ Pa), is in its gaseous phase and has a density that is less than or equal to that of the normal-pentane considered under the same conditions.

By density of a gaseous fluid, we mean the ratio between the density of this fluid and the density of dry air and with a normal carbon dioxide content, these two densities being measured under the same temperature and pressure conditions.

The density of the adjunctive fluid will be measured, at 40° C. and under a pressure of $1.0134.10^5$ Pa (1 atmosphere), by applying to said fluid one of the standardized methods of measurement described in the ASTM standard D1070–85 (R94). The same goes for the normal-pentane. The densities of said adjunctive fluid and of the pentane will be taken into consideration by reference to the same method of measurement.

According to the invention, the adjunctive fluid is in a gaseous phase at 40° C. under a pressure of $1.0134.10^5$ Pa (1 atmosphere). On the other hand, it is introduced in the upstream part of the reaction zone under temperature and pressure conditions that depend directly on the process conditions of the method. Based on its composition, it can then be in a liquid or gaseous phase or even in an intermediary phase.

Advantageously, said adjunctive fluid contains a substantial quantity of hydrogen and/or hydrocarbons that contain from one to five carbon atoms. Preferably, this adjunctive fluid contains a substantial quantity of hydrogen and/or hydrocarbons that contain from one to four carbon atoms, the preferred hydrocarbons being methane and ethane. This fluid can also, for example, consist of natural gas.

This fluid can also contain, in a smaller quantity, hydrocarbons with six or seven carbon atoms, and/or inert gases such as nitrogen, or any other appropriate light fluid.

Advantageously, said adjunctive fluid contains a substantial quantity of light compounds resulting from a fractionating tower located downstream from the isomerization unit.

The introduction of light adjunctive fluid creates, in the upstream part of reaction zone, a vaporization of a portion of the liquid fraction of the hydrocarbonic charge. This phenomenon is endothermic and helps to restore the heat balance within the reactor. We can thus compensate for the excess heat that emanates in the upstream part of the first reactor, following the hydrogenation of the benzene that is present in a higher quantity in the charge.

Furthermore, the drop in temperature within the reactor, resulting from the injection of said fluid, can be perfectly determined. Indeed, this injection results in a modification of the balances between the liquid fractions and the hydrocarbon vapors that make up the charge, balances that are governed by the thermodynamics laws.

Therefore, this drop in temperature depends solely on the following parameters: flow rates and compositions of the charge and of the adjunctive fluid, pressure, temperature, vaporized fraction of the charge upon entering the reactor and mass ratio between the hydrogen and the charge in the reaction mixture allowed in the unit. It can therefore be perfectly controlled and optimized based on the benzene content of the charge to be isomerized.

Thus, the method as set forth in the invention is precise and extremely flexible, to the extent that the flow rate of the adjunctive fluid can be regulated so as to compensate exactly for the rise in temperature caused by a benzene content that is greater than the usually accepted maximum content.

Thanks to the method as set forth in the invention, it now becomes possible to introduce, on charge of the isomerization unit, a greater fraction of gasoline rich in benzene, such as the light gasolines resulting from the catalytic reforming ("light reformate") and/or cracking, alone or mixed with other charges. The benzene that is present in a large quantity in these cuts will be hydrogenated and therefore totally transformed into less toxic compounds within the isomerization unit. In this way, the benzene content of the "reduced gasoline cut", consisting of the isomerate, the light reformate and the heavy reformate, can be appreciably reduced. The impact in terms of toxicity reduction of the fuels is far from being insignificant. Also, the method as set forth in the invention turns out to be very advantageous for the units that do not have, downstream of the isomerization unit, a deisohexanizer (separation column for the sought branched paraffins and for straight paraffins), with the recycling of a cut that is rich in straight paraffins upstream of the isomerization unit.

Indeed, one of the objects of the recycling is to dilute the charge that has just been added to the unit, in order to lower its benzene content. Thanks to this invention, since it is possible to introduce charges with higher benzene contents into the unit, this dilution is no longer necessary.

Therefore, for such units, the method as set forth in the invention represents a very valuable alternative to the costly installation of a deisohexanizer and a recycling system.

Lastly, unexpectedly so, the method as set forth in the invention has proved to allow for an increased recuperation of light hydrocarbons that contain at the most four atoms of carbon, and in particular propane and butane. These compounds are particularly interesting, all the more because they are amenable to beneficiation as GPL (Liquid Petroleum Gas), which is traditionally used as a fuel. The isomerization unit can thus be developed with a view to increase the production of these GPLs.

In accordance with the invention, the adjunctive fluid is injected in the upstream part of the reaction zone. This means that said fluid can be injected in the upstream part of the actual first reactor, and/or immediately upstream of the latter.

Preferably, the adjunctive fluid is injected in the upstream part of the first isomerization reactor, that is to say in the zone that extends from the introduction level of the reaction mixture (charge and hydrogen) in the reactor to half-way up the catalytic bed. Some adjunctive fluid can then be injected into the reactor zone contained between the introduction of the reaction mixture and the beginning of the dense bed of the catalyst. Advantageously, some adjunctive fluid can also be injected directly into the dense bed of catalyst, into the first half of the latter.

When adjunctive fluid is injected immediately upstream from the first reactor, it is introduced immediately, prior to the introduction of the reaction mixture (charge and hydrogen) in the first reactor, meaning after a complete preheating of this mixture and prior to the injection of the latter in the first reactor.

This injection of adjunctive fluid has a purely thermal effect and therefore does not have anything to do with the injection, in large quantity, of the hydrogen necessary for the actual isomerization reaction, which takes place, as known, upstream form the isomerization unit, meaning upstream from the heat exchangers in which the reaction mixture (charge and hydrogen) is reheated prior to being introduced in the reactor.

Therefore, this injection of adjunctive fluid is also carried out in a totally different location compared to the usual hydrogen injection upstream from the unit, and with a much weaker volume flow rate. In addition, its role is entirely different: this adjunctive fluid, which has a purely thermal effect, can consist of any light gas that is compatible with the method, whereas the hydrogen introduced upstream from the isomerization unit has a chemical effect at the level of the actual reaction.

This adjunctive fluid is advantageously injected at a flow rate of 5 to 150 $Nm^3$ per $m^3$ of charge to isomerize and, preferably of 5 to 60 $Nm^3$ per $m^3$ of charge. We are considering here the starting charge, prior to its mixture with hydrogen and prior to the heating of the reaction mixture thus obtained.

The effect that is sought is obtained: that the adjunctive fluid be injected at a temperature that is less than or greater than that of the reaction medium. Having said this, it is preferable to inject said fluid at a temperature that is less than or equal to that of the reaction medium, and, preferably, ranging between 20 and 180° C.

When the isomerization unit consists of several successive reactors, a particularly advantageous alternative of the invention consists in recycling, immediately downstream from the first reactor, a cut that is rich in slightly branched paraffins with 5 or 6 carbon atoms and that generally contains naphthenes. This cut results, as known, from a fractionation that exists in the perfected isomerization units, is located downstream from the reactors, and separates the sought isoparaffins from the other compounds.

In the prior art, this recycling cut, which does not contain any benzene, is traditionally introduced upstream from the first reactor, in order not only to execute an additional passage through the isomerization unit, but also to dilute the charge that has just been admitted in the unit, so as to lower the benzene content of the combined charge so obtained.

Thanks to this invention, since it is possible to allow charges with a higher benzene content in the first reactor, this dilution is no longer necessary, so that only the new charge is treated in the first reactor.

A much better valorization results from this first reactor along with a considerable improvement of the isomerization reactions that take place therein. Indeed, the flow of the charge is weaker, which is translated by a reduction of the hourly volume speed, and therefore, a greater contact time between the charge and the catalyst. In addition, recycling this cut downstream from the first reactor makes it possible not to circulate the naphthenic compounds in this reactor, compounds which are known for being isomerization reaction inhibitors.

The invention also seeks to propose a device that will allow for the implementation of the method addressed above.

To this end, the object of the invention is an isomerization device for a hydrocarbonic charge that contains a substantial quantity of paraffin base hydrocarbons with 5 or 6 carbon atoms and a benzene content that is greater than or equal to 2% by weight, said device will have at least one reactor charged with a fixed bed catalyst, an incoming line into the reactor for the reaction mixture which consists of the charge mixed with a hydrogen rich gas, at least one heating system for said reaction mixture upstream from the reactor, and an evacuation line from the reactor for the charge that is enriched in isoparaffins; this device is characterized by the fact that, at least one means of introduction of an adjunctive fluid runs into the upstream part of the reaction zone, this fluid is in a gaseous phase at 40° C., under atmospheric pressure ($1.0134.10^5$ Pa).

When the adjunctive fluid is introduced immediately upstream from the first isomerization reactor, an adjunctive fluid supply line runs into the incoming line of the first reactor of the reaction mixture (charge and hydrogen), between the most downstream reaction mixture heating device and the injection point of said mixture in the first reactor.

When the adjunctive fluid is introduced into the first reactor, at least one means of introduction of the adjunctive fluid leads into this reactor, upstream from the dense bed of the catalyst and/or into the first half of the latter. Said means can then consist of any known means that will allow, downstream from the injection of the actual charge, for the introduction of a light fluid in a reactor.

It can for example be a rod (or even a simple tube) with side slots or several holes, in order to allow for a better distribution of the adjunctive fluid. Preferably, we will use a diffuser that will make it possible to introduce the adjunctive fluid in a homogenous manner over the entire part of the reactor.

These means of introduction of the adjunctive fluid can lead into the reactor in several ways. According to one preferred mode of execution, said means emerge transversally in the reactor, considerably perpendicular to the axis of the latter.

According to another alternative, at least one means of introduction of the adjunctive fluid emerges in the reactor in a manner that is considerably parallel to the axis of the latter. Preferably, said means then penetrates into the reactor through the hole that allows for the introduction of the reaction mixture. This solution is particularly advantageous in the scope of modernization of existing units, since it avoids having to go through the wall of the reactor.

The invention does not relate to catalysts that are likely to interfere with its implementation. We can indeed use any known catalyst that shows an activity for the isomerization of straight paraffins into branched paraffins. In this field, many catalysts are known to the person skilled in the art. They usually contain one or several acid type functions, as well as a hydrogenating function (hydrogenating transition metal). We can name, as a non restrictive example, aluminum chloride base catalysts (or catalysts with other halogenated sites) and catalysts that contain one or several metals of group VIII of the Periodic table of the elements.

BRIEF DESCRIPTION OF THE DRAWINGS

Other characteristics and advantages of the invention will appear as you read the following description of various methods of its implementation. In this description, we will refer to the attached drawings, where.

DETAILED DESCRIPTION OF THE PREFERRED EMBODIMENTS

Figure 1:
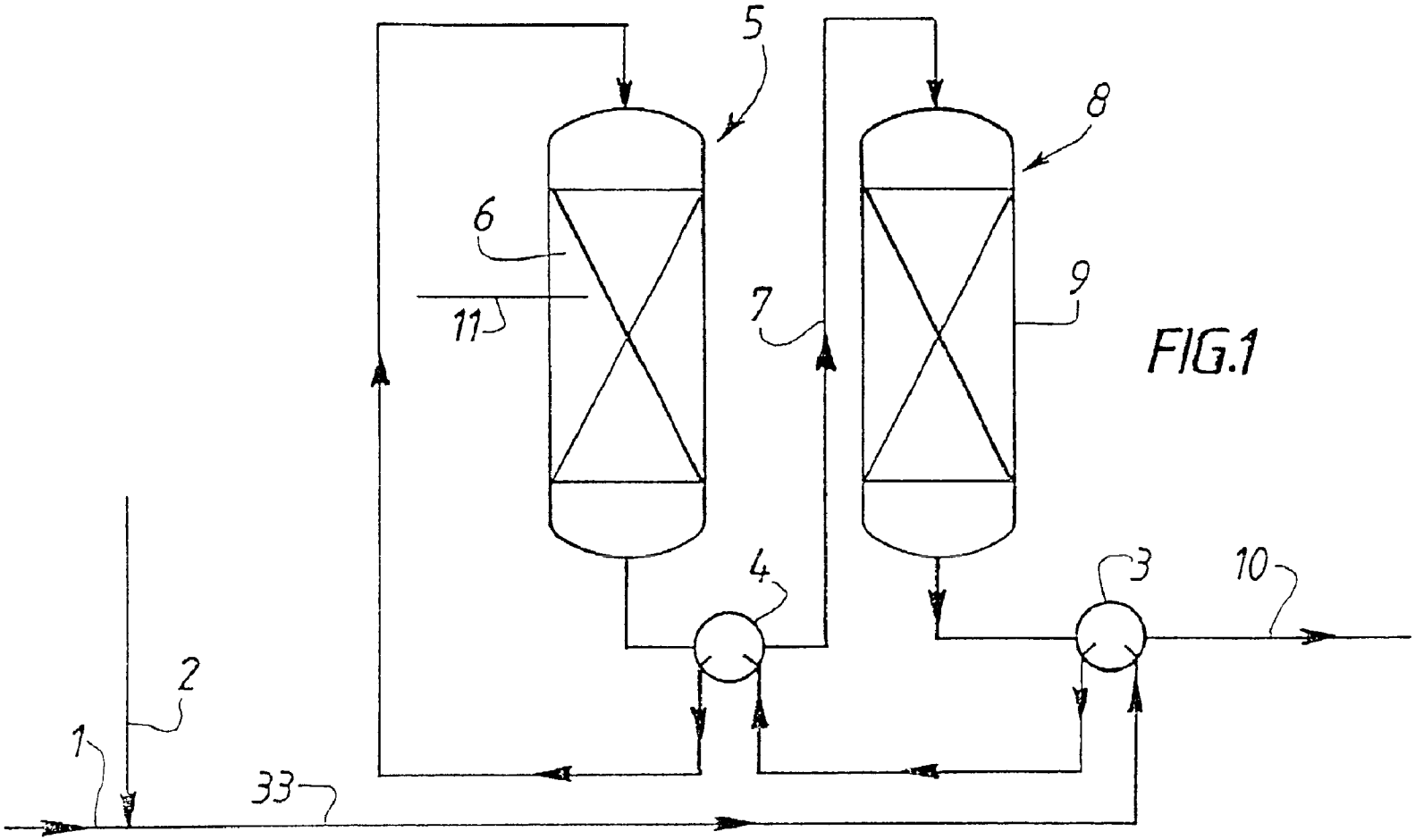
FIG. 1 is a diagrammatic view of an isomerization unit that includes an injection of an adjunctive fluid, as set forth in the invention.

FIG. 1 represents a unit for the isomerization of cuts that contain straight paraffins with 5 or 6 carbon atoms. This charge arrives through line 1, in which hydrogen and possibly recycling gases are introduced through line 2. The reaction mixture thus obtained is carried by line 33 toward two heat exchangers 3 and 4, against the flow of effluents from the two isomerization reactors of the unit. The reaction mixture thus heated is then introduced in a first reactor 5, or upstream reactor. The latter contains an isomerization catalyst distributed in a catalytic bed 6, that takes up a large part of the height of the reactor 5. The effluent of the latter, after passing through the exchanger 4, is then introduced through line 7 into the second reactor 8, or downstream reactor, which is also charged with an isomerization catalyst distributed in a catalytic bed 9.

In this case, the charge to be treated circulates from top to bottom in the reactors 5 and 8 but is could naturally circulate from bottom to top.

The effluent of the downstream reactor 8, which contains a charge enriched with isoparaffins, is evacuated through line 10 and, after having gone through the exchanger 3, is directed toward a product separation set (not represented). The device consists furthermore of valve systems, not represented, that make it possible to independently interrupt the feeding of reactors 5 and 8 and/or reverse the direction of the circulation of the reaction mixture.

As set forth in the invention, an adjunctive fluid is injected into the upstream reactor 5, through a rod 11 considerably perpendicular to the axis of the reactor that leads directly into the catalytic bed, in the first half of the latter. This rod is fitted with side slots, not represented, that allow for a better distribution.

Figure 2:
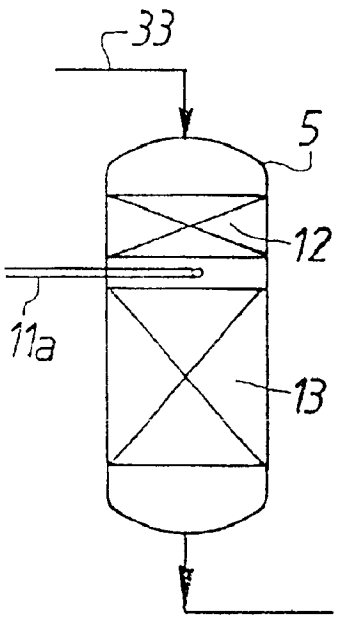

According to a variation in execution represented in FIG. 2, the catalytic bed 6 of the upstream reactor 5 can be separated into an upstream section 12 and a downstream section 13, which contain the same isomerization catalyst.

The rod 11*a* for the introduction of the adjunctive fluid then penetrates into the reactor between the two catalytic sections 12 and 13.

Figure 3:
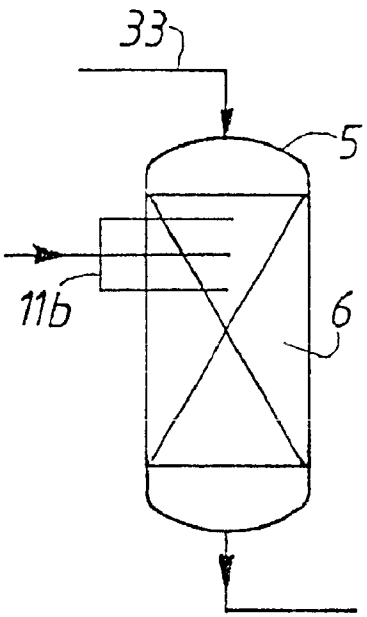

According to another variation in execution represented in FIG. 3, a tiered injection system 11*b* allows for the introduction of adjunctive fluid at several levels in the first half of the catalytic bed 6 of the reactor 5.

Figure 4:
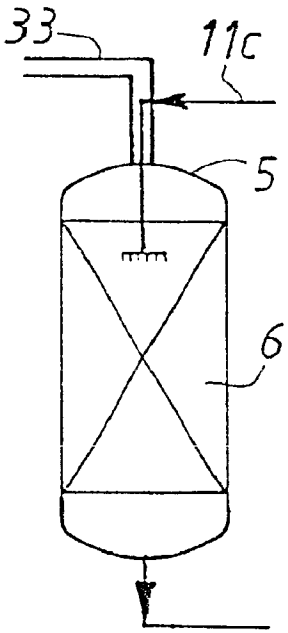

According to another variation in execution represented in FIG. 4, an injection system 11*c* of adjunctive fluid leads into the reactor 5, so as to be considerably parallel to the axis of the latter, at the level of the hole that makes it possible to introduce the reaction mixture (charge and hydrogen) carried to the reactor through line 33.

Figure 5:
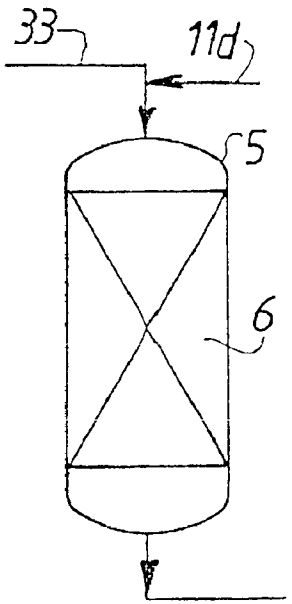
FIGS. 2, 3, 4 and 5 are execution variations of FIG. 1.

According to yet another variation of execution represented in FIG. 5, a supply line 11*d* for the adjunctive fluid comes out into the incoming line 33 of the reaction mixture (charge and hydrogen), immediately upstream from the first isomerization reactor 5.

We must note that, in the case where the isomerization unit contains at least two successive reactors, the injection of the adjunctive fluid always takes place at the level of the upstream reactor, to the extent that the hydrogenation of the benzene is much faster that the isomerization of the paraffin itself and only occurs within the upstream reactor.

Furthermore, in these units that consist of two or more reactors, it is common to reverse the direction of the reaction mixture circulation, particularly after replacing the catalytic bed of one of the reactors. The upstream reactor then becomes the downstream reactor and vice versa. As a result, the adjunctive fluid introduction point(s) must be moved so that this introduction still takes place in the upstream reactor.

This is why it can be important to anticipate an adjunctive fluid injection system on each of the two reactors placed at the extremity of the series. Of course, only one of these systems will be in use at any given time, based on the direction of the circulation of the reaction mixture.

Lastly, in the case of a unit that only consists of one reactor, the injection of the adjunctive fluid is similar to that represented in FIGS. 1 through 5.

Figure 6:
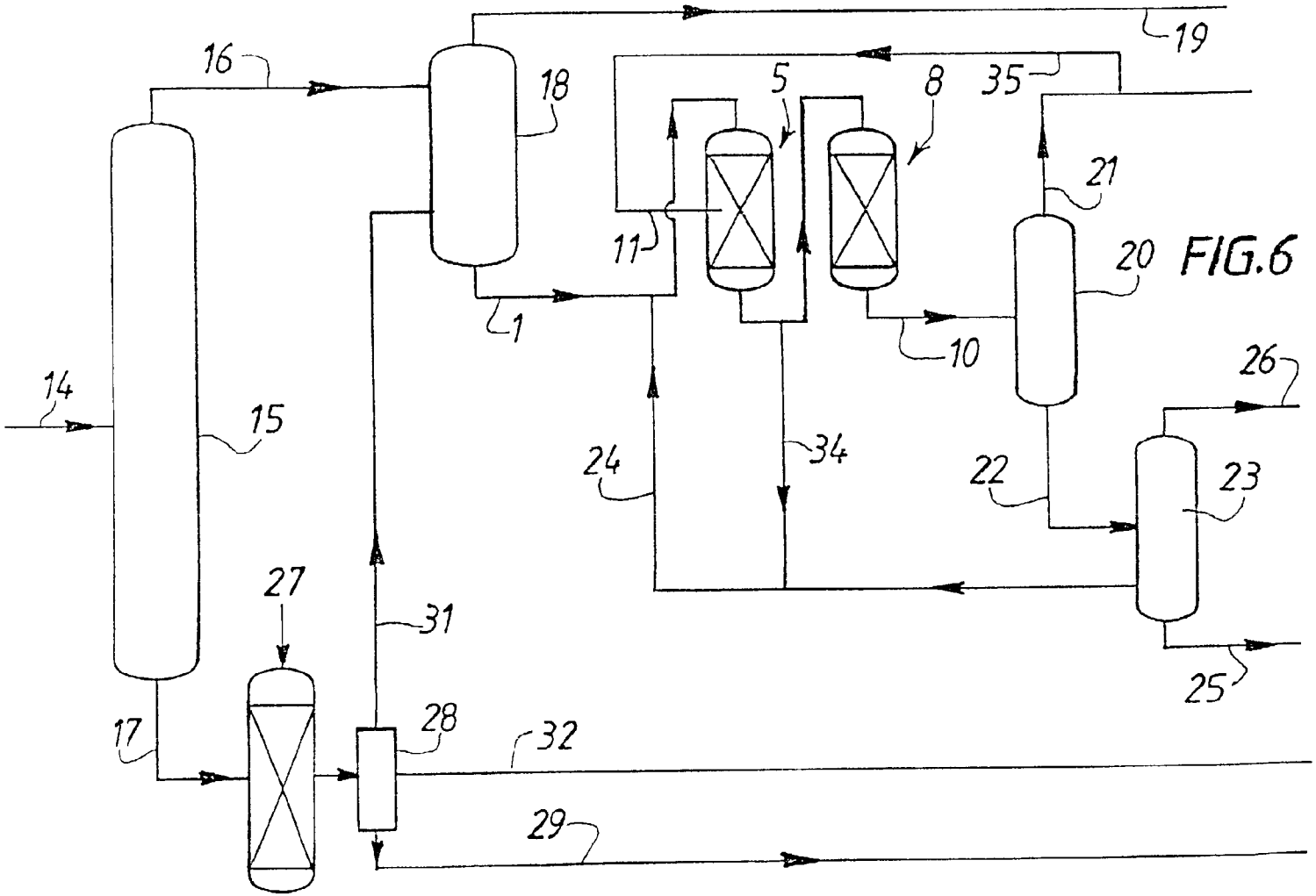
FIG. 6 is a synoptic view that illustrates the relations of an isomerization unit with other oil units, as they exist in the prior art, on the one hand, and as they are modified in accordance with the invention on the other hand.

FIG. 6 illustrates how the invention can make it possible to improve the relations that exist between the isomerization unit and other oil units.

As represented in this Figure, the direct distillation gasoline (or "straight-run") which corresponds to a distillation cut between approximately 20 and 180° C., exits through line 14 from a main fractionation unit, not represented.

This direct distillation gasoline is then divided, within the separator 15, into a light gasoline, evacuated through line 16 and a heavy gasoline, evacuated through line 17, the cutting point between these two fractions being usually located between 70 and 90° C. The light gasoline is then relieved, in the deisopentanizer 18, of its isopentane and is directed by line 1 toward the isomerization unit.

Therefore, the isopentane rich fraction, which is a compound with a high octane number that does not need any isomerization treatment, is evacuated through line 19. The light gasoline weakened in isopentane then passes through the two isomerization reactors 5 and 8 as described above, and the charge enriched in isoparaffins is extracted therefrom through line 10.

This charge is then separated, within the stabilizer 20, in a top cut 21, consisting of compounds with a maximum of four carbon atoms, and a bottom cut 22 of heavier compounds. The latter is then directed toward the deisohexanizer 23, where it is divided into an isomerate 26, consisting of isoparaffins with 5 or 6 carbon atoms, and a heavy cut 25, consisting mostly of naphthenes and paraffins with 7 or more carbon atoms. Furthermore, a cut rich in non isomerized naphthenes and paraffins with 5 or 6 carbon atoms is traditionally recycled upstream from the first reactor through line 24. Thus, this cut, which does not contain any benzene, not only completes an additional passage in the isomerization unit, but also allows for the dilution of the newly admitted charge in the unit, so as to lower the benzene content of the combined charge so obtained.

Still referring to FIG. 6, the heavy gasoline that is evacuated from the separator 15 through line 17 is directed toward the reforming unit 27, where it is subjected among other things to aromatization reactions, which contribute to the increase of its aromatic products content, including benzene. The reformate so obtained is then separated at the fractionation level 28 into a heavy reformate 29, whose boiling point is greater than approximately 90° C., that is carried toward the gasoline pool, and a light reformate 31, whose boiling point ranges between 30 and 90° C.

Most of the benzene produced in the reforming is present in the light reformate 31. In order to reduce the benzene content of the final gasoline, it therefore makes sense to send the light reformate 31 toward the reactors 5, 8 of the isomerization unit. However, the latter cannot treat charges with a high benzene content, making it necessary to either extract from the fractionation, through line 32, a benzene cut that is not easily amenable to beneficiation because it is not pure enough, or to increase the recycling flow rate of line 24, in order to lower the benzene content of the combined charge entering the reactor 5, at the expense of the quality of the actual isomerization reactions.

The remainder of the description will highlight the modifications made possible by the invention, in particular relating to the use of the light reformate 31 and the recycled fraction 24 during isomerization.

In accordance with the invention, a means of injection 11 of an adjunctive fluid, penetrates into the catalytic bed of the upstream reactor 5. The adjunctive fluid consists of compounds that contain at the most 4 carbon atoms brought about through line 35 from the top cut, evacuated in 21, from the stabilizer 20. In this way, the isomerization unit is susceptible of treating if necessary, charges whose benzene content is greater that in the prior art. Thus, the doubling of the quantity of benzene present in the charge can be thermally compensated for by an additional light fluid (density less than or equal to that of normal-pentane), whose flow rate will be regulated based of the benzene content of the charge to be isomerized.

This increase of the benzene content that is admissible allows for a greater flexibility at the isomerization level and the level of surrounding units. Thus, it is possible to send in the isomerization charge a higher flow rate of light reformate 31, without increasing the recycling flow rate 24, which does harm to the quality of the isomerization reactions.

As for the extraction of the benzene cut 32 that is not easily amenable to beneficiation, it will be less consistent.

It is also possible to replace recycle 24 with recycle 34, immediately downstream from the first isomerization reactor 5. This results in a much better beneficiation of this first reactor 5, and a considerable improvement of the isomerization reactions that take place therein: on the one hand, the flow of the charge is weaker; on the other hand, we avoid having to circulate a recycle 24 in the first reactor, and thus the naphthenic compounds present in this recycle which inhibit the isomerization reactions.

The following examples, which are in no way restrictive, are intended to illustrate the implementation and advantages of the invention.

EXAMPLE 1

The object of this example is to illustrate the limitations of traditional gasoline isomerization methods, in the case of the treatment of charges with a high benzene content.

A gasoline cut of the direct distillation light gasoline type (charge No1) has the following properties:

ASTM distillation point 5% (by volume): 31° C.

ASTM distillation point 95% (by volume): 86° C.

Sulfur content: 1 ppm by weight

Nitrogen content: 1 ppm by weight

Benzene content: 3.5% by weight

Density at 15° C.: 0.680

This charge, whose flow rate is 91.7 t/h, is combined with a gaseous mixture that is rich in hydrogen (20% by weight of hydrogen), introduced at a flow rate of 2 t/h. This reaction mixture is then heated to 133° C., then treated in a traditional gasoline isomerization unit consisting of two successive reactors, operating at a pressure of $31.10^5$ Pa. The temperature noted when exiting the first reactor is 180° C.

The test is completed again, with a charge that is in accordance with that described previously, but to which a high benzene content is added: this charge No2 has a benzene content of 7.66% by weight and a density at 15° C. of 0.687. The other properties remain for the most part unchanged with regard to charge No1.

This charge No2 is treated under the same process conditions as those mentioned above for the treatment of charge No1, with the exception of the flow rate of the gas rich in hydrogen, which is brought to 3.5 t/h (as we know, the isomerization of charges rich in benzene require an increased quantity of hydrogen in the reaction medium, considering the additional consumption of hydrogen induced by the hydrogenation of the benzene).

The high temperature noted at the output of the first reactor is then 193° C. Therefore, there is an increase of temperature of 13° C. in this reactor due to the large quantity of heat that emanates from the hydrogenation of the additional benzene present in charge No2. Eventually, this temperature rise in the first reactor could not only damage the catalyst and the unit, but also reduce the performance of the isomerization reaction (best at low temperatures).

Therefore, this example illustrates just how the methods of the prior art are badly adjusted to the isomerization of charges with a high benzene content.

EXAMPLE 2

In this example, the charge rich in benzene described previously (charge No2) is now treated according to the isomerization method as set forth in the invention. An adjunctive fluid is therefore introduced in the catalytic bed of the first reactor, at the level of the first third of the catalytic bed (at 2/7 of this bed, to be exact), and with a flow rate of 30 $Nm^3$ per $m^3$ of charge. Two temperatures of adjunctive fluid introduction were tested: 30° C. (temperature less than that of the reaction medium) and 145° C. (temperature in the same range as that of the reaction medium).

Various compositions of the adjunctive fluid, mentioned in Table I hereafter, were tested successively.

TABLE I

| Fluid | Composition (in % by weight) | Density (40° C., 1.0134 Pa) |
|---|---|---|
| F1 | 2% $H_2$ + 12% $CH_4$ + 18% $C_2H_6$ + 25% $C_3H_8$ + 43% $C_4H_{10}$ | $1.04.10^{-3}$ |
| F2 | 2% $H_2$ + 80% $CH_4$ + 16% $C_2H_6$ + 2% $C_3H_8$ | $0.59.10^{-3}$ |
| F3 | 100% $H_2$ | $0.08.10^{-3}$ |
| F4 | 100% $CH_4$ | $0.62.10^{-3}$ |
| F5 | 100% $C_2H_6$ | $1.16.10^{-3}$ |
| F6 | 100% $C_3H_8$ | $1.72.10^{-3}$ |
| F7 | 100% $nC_4H_{10}$ | $2.28.10^{-3}$ |
| F8 | 100% $nC_5H_{12}$ | $2.87.10^{-3}$ |

Fluid F1 corresponds to a gaseous mixture of the same type as those that can be recuperated at the top of a fractionating tower located downstream from the isomerization unit (called stabilizer).

At 40° C., under a pressure of $1.0134.10^5$ Pa (1 atmosphere), all fluids taken into consideration are in a gaseous phase and have a density that is less than or equal to that of the pentane ($C_5H_{12}$, fluid F8) taken into account under the same conditions.

For the isomerization test, the process conditions are identical to those described in Example 1 for the treatment of charge No2, and the entry temperature of the reaction mixture in the first isomerization reactor is maintained at 133° C.

Table II hereafter brings together the results obtained as far as the exit temperature of the first reactor is considered.

TABLE II

| Adjunctive fluid | Exit temperature of the first reactor (1) | (2) |
|---|---|---|
| F1 | 180° C. | 183° C. |
| F2 | 180° C. | 181° C. |
| F3 | 181° C. | 182° C. |
| F4 | 179° C. | 180° C. |
| F5 | 180° C. | 182° C. |
| F6 | 179° C. | 184° C. |
| F7 | 181° C. | 187° C. |
| F8 | 184° C. | 189° C. |

(1) Temperature of introduction of the adjunctive fluid in the first reactor: 30° C.

(2) Temperature of introduction of the adjunctive fluid in the first reactor: 145° C.

Identical results to those displayed above were obtained by introducing the adjunctive fluid immediately upstream from the first isomerization reactor, between the heating device of the most downstream reaction mixture and the injection point of said mixture in the first reactor.

As shown in Table II above, the introduction of a light adjunctive fluid makes it possible to compensate for the excess heat that emanates in the first reactor in the presence of a charge that is rich in benzene. We can also lower the temperature in this reactor and, in particular, bring its exit temperature back to a value that is identical to, or very close to, that of the temperature noted during isomerization of the charges with a limited benzene content (charge No1).

Also, different results are obtained depending on the adjunctive fluid used. In particular, when the adjunctive fluid is introduced at a high temperature, the lowering of the first reactor's temperature is greater that with light fluids. Therefore, it is possible to adjust the composition of the fluid introduced to the benzene content of the charge being isomerized, resulting in an excellent flexibility of the method as set forth in the invention.

EXAMPLE 3

In this example, in tests 2 through 4, the charge that is rich in benzene (charge No2 of Example 1) is isomerized by applying the method as set forth in the invention and under process conditions that are identical to those used in Example No2, but by varying the flow rate of the adjunctive fluid. The three tests mentioned in Table III below were carried out with the same fluid F2, introduced in the catalytic bed of the first reactor at a temperature of 145° C.

Test 1 corresponds to a no flow rate of the adjunctive fluid (prior art).

TABLE III

| Test | Flow rate of the adjunctive fluid (Nm3 per m3 of charge) | Exit temperature of the first reactor (° C.) |
|---|---|---|
| 1 | 0 | 193 |
| 2 | 10 | 188 |
| 3 | 30 | 181 |
| 4 | 60 | 173 |

This example illustrates the excellent thermal control that can be attained using the invention. This control is extremely precise and flexible, since the flow rate of the adjunctive fluid can be optimized in relation to the characteristics of the charge to be treated and, in particular, to its benzene content.

EXAMPLE 4

This example makes it possible to specify the conditions under which the method as set forth in the invention must be implemented, and particularly the nature of the adjunctive fluids that are likely to be used.

The process conditions are identical to those of Example 2.

Different adjunctive fluids were tested successively:

F1, F5 and F8 are fluids that were already mentioned in Example 2 and correspond to the conditions of the invention: gaseous fluids at 40° C., under a pressure of 1.0134.Pa (1 atmosphere) and with a density that is less than or equal to that of pentane ($C_5H_{12}$, fluid F8) taken into account under the same conditions.

F9 and F10 are fluids that are heavier than the pentane.

These fluids are all injected in the catalytic bed of the first reactor at a temperature of 145° C., and at a flow rate of 30 $Nm^3$ per $m^3$ of charge.

Table IV hereafter displays the natures of the fluids that were tested as well as the results obtained during isomerization tests of charge No2 that is rich in benzene.

TABLE IV

| Fluid | Composition | Physical state (density) at 40° C., $1.0134.0^5$ Pa | Exit temperature of the 1st reactor (° C.) |
|---|---|---|---|
| F1 | Mixture ($H_2$, $C_1$ to $C_4$) | Gaseous ($1.04.10^{-3}$) | 183 |
| F5 | 100% $C_2H_6$ | Gaseous ($1.16.10^{-3}$) | 182 |
| F8 | 100% $nC_5H_{12}$ | Gaseous ($2.87.10^{-3}$) | 189 |
| F9 | 100% $nC_6H_{14}$ | Liquid | 192 |
| F10 | 100% $nC_9H_{20}$ | Liquid | 196 |

These results emphasize the validity of the criteria retained in selecting the adjunctive fluids that are likely to be used in this invention.

For fluids that are too heavy, and in particular heavier than pentane, the thermodynamic effect described no longer occurs and the injection of adjunctive fluid no longer makes it possible to lower the temperature of the first reactor. We even observe that, when such a fluid is introduced at a temperature that is greater than or equal to the entry temperature in the reactor, as is the case in this example, we may end up with an additional increase of the temperature of this reactor (see the case of fluid F10).

What is claimed is:

1. Isomerization device for a hydrocarbonic charge that contains a substantial quantity of paraffin base hydrocarbons with 5 or 6 carbon atoms and whose benzene content is greater than or equal to 2% by weight, said device contains at least one reactor (5) charged with a fixed-bed catalyst (6), an incoming line (33) to the reactor (5) for the reaction mixture consisting of the charge mixed with a gas that is rich in hydrogen, at least one heating system (3, 4) of said reaction mixture upstream from the factor (5), and an evacuation line (10) from the reactor (5) for the charge enriched with isoparaffins, said device being wherein, in the upstream section of the reaction zone, emerges at least one means (11) of introduction of an adjunctive fluid, that is in a gaseous phase at 40° C., under atmospheric pressure ($1.0134.10^5$ Pa).

2. Device as set forth in claim 1, wherein a supply line **(11*d*) for adjunctive fluid leads into the incoming line (33) to the first reactor (5) of the reaction (charge and hydrogen), between the preheating device of the most downstream (4) reaction mixture and the injection point of said mixture in the first reactor (5)**.

3. Device as set forth in claim 1, wherein at least one means **(11, 11*a*, 11*b*, 11*c*) of introduction of the adjunctive fluid leads into the first reactor (5), upstream from the dense bed catalyst (6)** and/or into the first half of the latter.

4. Device as set forth in claim 3, wherein at least one means (11) of introduction of the adjunctive fluid consists of a rod or a tube fitted with side slots or several holes, in order to allow for a better distribution of the adjunctive fluid.

5. Device as set forth in claim 3, wherein at least one means (11) of introduction of the adjunctive fluid consists of a diffuser that allows for the introduction of adjunctive fluid in a homogenous manner over the entire section of the reactor (5).

6. Device as set forth in claim 3, wherein at least one means **(11, 11*a*, 11*b*) of introduction of the adjunctive fluid runs transversally into the reactor (5)**, considerably perpendicular to the axis of the latter.

7. Device as set forth in claim 3, wherein at least one means **(11*c*) of introduction of the adjunctive fluid runs into the reactor (5) in a manner considerably parallel to the axis of the latter and penetrates into the reactor (5)** by the orifice that allows for the introduction of the reaction mixture.

8. Device as set forth in claim 1, wherein the catalytic bed of the first isomerization reactor (5) is separated into a distinctive upstream section (12) and downstream section (13), a means **(11*a*) of introduction of the fluid that penetrates in the reactor (5) between the two catalytic sections (12) and (13)**.

* * * * *